US011492730B2

(12) United States Patent
da Costa Pereira Machado et al.

(10) Patent No.: US 11,492,730 B2
(45) Date of Patent: Nov. 8, 2022

(54) TEXTILE INCLUDING BULKING YARN

(71) Applicant: NIKE, Inc., Beaverton, OR (US)

(72) Inventors: Fabricio da Costa Pereira Machado, Portland, OR (US); Kristen Orme, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 220 days.

(21) Appl. No.: 15/631,344

(22) Filed: Jun. 23, 2017

(65) Prior Publication Data

US 2017/0370027 A1 Dec. 28, 2017

Related U.S. Application Data

(60) Provisional application No. 62/355,153, filed on Jun. 27, 2016.

(51) Int. Cl.
*A43B 23/04* (2006.01)
*A43B 23/02* (2006.01)
(Continued)

(52) U.S. Cl.
CPC ..... *D02G 3/24* (2013.01); *A43B 1/04* (2013.01); *A43B 7/142* (2013.01); *A43B 23/025* (2013.01);
(Continued)

(58) Field of Classification Search
CPC ..... A43B 1/04; A43B 23/025; A43B 23/0215; D02G 3/24
See application file for complete search history.

(56) References Cited

U.S. PATENT DOCUMENTS 3,166,822 A * 1/1965 Starkie ..... D02G 1/004 432/8
5,543,194 A * 8/1996 Rudy ..... A43B 13/189 428/69
(Continued)

FOREIGN PATENT DOCUMENTS

CN 1037828 12/1989
CN 1038018 A 12/1989
(Continued)

OTHER PUBLICATIONS

Communication from the European Patent Office dated Feb. 5, 2019 for EP Application No. 17735333.1 (3 pg.).
(Continued)

*Primary Examiner* — Jila M Mohandesi
(74) *Attorney, Agent, or Firm* — Shook, Hardy & Bacon, L.L.P.

(57) ABSTRACT

In one aspect, a textile component including bulking yarn is disclosed. In embodiments, the textile component is a knitted component. In one embodiment, an article of footwear includes a knitted component arch support configured to reduce the rate of pronation. A support structure may include a fusible yarn adjacent to an external surface of the arch support, a bulking yarn, and a nonfusible yarn. In certain embodiments, an arch support includes compartments and flex lines. In another aspect, an article having a knitted component includes a rigid material, a bulking yarn, and a flexible material. The rigid material may be fusible yarn. Methods for forming a textile component are provided. One embodiment involves knitting a first section comprising a fusible yarn, a second section comprising a bulking yarn, and a third section comprising a nonfusible yarn, and heating.

7 Claims, 6 Drawing Sheets

(51) Int. Cl.

| | |
|---|---|
| ***D02G 3/24*** | (2006.01) |
| ***A43B 23/22*** | (2006.01) |
| ***A43B 7/142*** | (2022.01) |
| ***A43B 1/04*** | (2022.01) |
| ***D04B 1/12*** | (2006.01) |
| ***D02G 3/32*** | (2006.01) |
| ***D02G 3/44*** | (2006.01) |

(52) U.S. Cl.

CPC ..... *A43B 23/042* (2013.01); *A43B 23/22* (2013.01); *D02G 3/32* (2013.01); *D02G 3/44* (2013.01); *D04B 1/12* (2013.01); *D10B 2403/032* (2013.01); *D10B 2501/043* (2013.01)

(56) References Cited

U.S. PATENT DOCUMENTS

| | | | | |
|---|---|---|---|---|
| 5,795,835 | A | 8/1998 | Bruner et al. | |
| 5,901,394 | A | 5/1999 | Greenawalt | |
| 5,965,467 | A * | 10/1999 | Stevenson | D03D 9/00 405/129.75 |
| 6,145,348 | A * | 11/2000 | Hardegree | D04B 27/06 28/158 |
| 6,484,419 | B1 * | 11/2002 | Rohde | A43B 7/141 36/10 |
| 8,448,474 | B1 * | 5/2013 | Tatler | D04B 1/104 66/64 |
| 8,997,529 | B1 * | 4/2015 | Podhajny | D04B 1/16 66/177 |
| 2011/0078921 | A1 * | 4/2011 | Greene | A43B 1/04 36/47 |
| 2012/0234052 | A1 * | 9/2012 | Huffa | D04B 1/22 66/64 |
| 2012/0279260 | A1 * | 11/2012 | Dua | D04B 1/16 66/171 |
| 2014/0150292 | A1 * | 6/2014 | Podhajny | A43B 23/0205 36/50.1 |
| 2014/0173932 | A1 * | 6/2014 | Bell | A43B 13/02 36/84 |
| 2014/0245633 | A1 * | 9/2014 | Podhajny | A43B 1/04 36/45 |
| 2014/0310986 | A1 * | 10/2014 | Tamm | A43B 1/00 36/84 |

FOREIGN PATENT DOCUMENTS

| | | | |
|---|---|---|---|
| CN | 104106874 | A | 10/2014 |
| CN | 105533889 | A | 5/2016 |
| CN | 207118646 | U | 3/2018 |
| DE | 102014102628 | A1 | 8/2015 |
| EP | 2 236 051 | A1 | 10/2010 |
| EP | 2 792 261 | A1 | 10/2014 |
| EP | 2 805 638 | A1 | 11/2014 |

OTHER PUBLICATIONS

International Preliminary Report on Patentability dated Jan. 1, 2019 for PCT Application No. PCT/US2017/038947 (7 pp.).

International Search Report and Written Opinion of the International Searching Authority dated Sep. 20, 2017 for PCT Application No. PCT/US2017/038947 (9 pp.).

Office Action and English Translation in corresponding Chinese Application No. 2017800403964, dated Sep. 2, 2020 (15 pages).

Office Action received for European Patent Application No. 17735333.1, dated Apr. 4, 2022, 6 pages.

* cited by examiner

TEXTILE INCLUDING BULKING YARN

RELATED APPLICATIONS

This application claims priority to U.S. Provisional Application No. 62/355,153 filed Jun. 27, 2016, and entitled "A Textile Including Bulking Yarns", the contents of which are incorporated by reference herein in their entirety.

FIELD

The present disclosure is directed to articles having a textile component, including articles of footwear and articles of apparel. The textile component may be a knitted component. More specifically, the present disclosure relates to articles of footwear and components thereof, including uppers having a knitted textile component which supports the foot during athletic activity

BACKGROUND

Articles of footwear are used for a variety of activities, including walking, running, and competitive sports. Incorrect pronation of the foot including overpronation and underpronation is a leading cause of sports injury. In certain sports such as tennis, volleyball and basketball, for example, tremendous pressure is exerted on the foot and ankle. Without proper equipment, the risk of injuries will increase. This includes acute injuries as, for example, from a sudden and forceful blow, and chronic injuries, which tend to develop slowly and may become aggravated over an extended period of time.

Common acute injuries include ankle strains and sprains, torn ligaments, muscle pulls, tendon ruptures, and fractures. Common chronic injuries include stress fractures, plantar fasciitis, shin splints, Achilles heel, tendinitis, patellar tendinitis, blisters and other undesirable conditions. Chronic injuries can be caused in part by undue stress on the feet and ankles. Unsupportive, worn-out and/or ill-fitting shoes and equipment may contribute to chronic injuries.

Conventional treatment for overpronation includes use of orthotic insoles, arch or heel supports, rollbars, medial posts, and related stability and cushioning elements. The goal of most stability shoes is to get users to pronate to the same extent. Recent research suggests, however, that the rate of pronation of the foot may be more important for the risk of injury as the range of pronation. It is therefore advantageous to provide footwear that can effectively reduce the rate of pronation, while promoting a more natural gait. It is also advantageous to provide footwear that provides a desired combination of stiffness and support while remaining flexible to accommodate natural movement and comfort.

SUMMARY

In one aspect, an article of footwear having a textile component arch support is disclosed for reducing the rate of pronation of the foot. In embodiments, the textile component is a knitted component. In one embodiment, the arch support includes a first section formed from a fusible yarn, a second section formed from a bulking yarn, and a third section formed from a nonfusible yarn and opposite to the first section. Upon heating, the bulking yarn expands and the fusible yarn melts to form a rigid backing. In some embodiments, the arch support includes compartments and flex lines to flex and form crush zones during movement.

In one aspect, an article having a textile component is disclosed. In embodiments, the textile component is a knitted component. In one embodiment, a knitted component includes a first section comprising a rigid material, a second section comprising a bulking yarn and adjacent to the first section, and a third section comprising a flexible material, wherein the second section is disposed between the first section and the third section. In some embodiments, the first section is disposed adjacent to the external surface of the article and the third section is disposed adjacent to the internal surface of the article. The rigid material may comprise a fusible yarn or stiffened plate. The flexible material may comprise a nonfusible yarn. In some embodiments, the knitted component forms an upper of an article of footwear.

In one aspect, methods are disclosed for forming a knitted component support structure for an article of footwear. In one embodiment, the method involves forming a first section comprising a fusible yarn; forming a second section comprising a bulking yarn adjacent to the first section; forming a third section comprising a nonfusible yarn adjacent to the second section and opposite to the first section; and heating the first section, second section, and third section to form a knitted component support structure. In a preferred embodiment, heating involves free steaming.

BRIEF DESCRIPTION OF THE DRAWINGS

Various embodiments are described with reference to the following drawings. These drawings are provided for illustration purposes only and should not be construed to limit the scope of the claimed invention. The person of skill in the art will understand that modifications, additions, and alternative embodiments may exist within the scope and spirit of the present disclosure, which are not necessarily identified by the foregoing drawings.

DETAILED DESCRIPTION

Figure 1C:
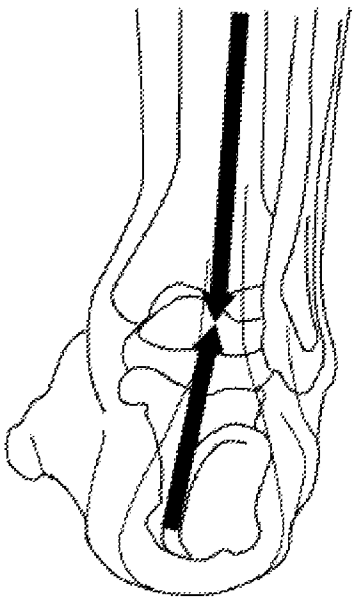
FIG. 1 illustrates the orientation of the foot and ankle in (1*a*) an overpronator, (1*b*) a normal subject; and (1*c*) a supinator.

The present disclosure is directed to articles having a textile component that includes a bulking yarn. Some embodiments of the disclosure are directed to an upper for an article of footwear and textile components having support structures.

In one embodiment described herein, an upper for an article of footwear is disclosed that is designed and configured to reduce the rate of pronation of the foot during physical activities such as running, jumping and walking. In some embodiments, the textile component is a knitted component. The disclosure is also directed to methods of making articles of footwear, uppers, and textile components having support structures with such properties. In one embodiment, a support structure for an article of footwear is configured using one or more of a bulking yarn, a fusible yarn, and a non-fusible yarn to provide stability, increase proprioceptive responsiveness, and promote a more natural gait. As discussed further below, it has been found that the articles and methods disclosed herein may reduce the rate of pronation of the foot to approximately that of a barefoot runner or walker during a running or walking activity. This reduction in the rate of pronation is associated with a reduced likelihood of sports-related injuries.

An upper for an article of footwear may be formed using various material elements including for example, knitted or woven textiles, leather, synthetic leather, and rubber, each of which imparts different properties to different regions of the upper. Each material element may then be joined using stitching, adhesives, or other methods. Alternatively, an upper may be formed using a single material element. For example, a knitted component may form an entirety of an upper, with differing stitch patterns and yarns used in different regions to impart different properties. A knitted component may also form some, all, or substantially all of a midsole, outsole, underfoot portion and/or strobel.

The upper may be formed with single layer construction or with multiple layers. In an upper having multiple layers, the outermost layer is generally constructed and configured to promote proper fit, water resistance, aesthetic appearance, support, durability, stiffness and/or stability. An intermediate layer, where present, may be formed from one or more materials or knitting techniques or combinations thereof that provides cushioning and enhances comfort. In one non-limiting example, this may include a lightweight polymer foam or insert, air pockets, and/or knitting loops structures, inlaid or floating yarns, spacer knits and bulking yarns. Similarly, an inner layer may be formed of a comfortable and moisture-wicking material or textile that allows perspiration to move away from the area around the foot.

The gait cycle is divided between a stance phase, which is the period when the foot is in contact with the ground, and a swing phase, which is the period between heel strike and toe off. There are three stages of the stance phase in a normal walker or runner. In the first stage (heel strike), the foot contacts the ground with the outside of the heel. In the second stage, the arch of the foot depresses and the foot rolls inward slightly (roughly 15% in a normal runner), distributing the weight of impact over a larger surface area. This natural inward roll of the foot is referred to as pronation. In the third stage, the foot rocks forward and the subject pushes off the front of the foot, with somewhat more of the load carried by the big toe and second toe. The forces involved, and the range and rate of pronation, are significantly increased during running activities.

Figure 1B:
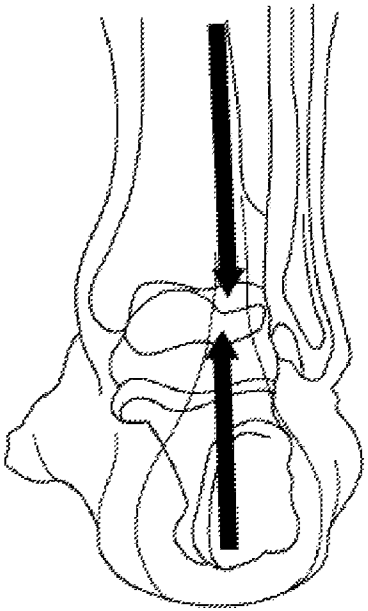
Figure 1A:
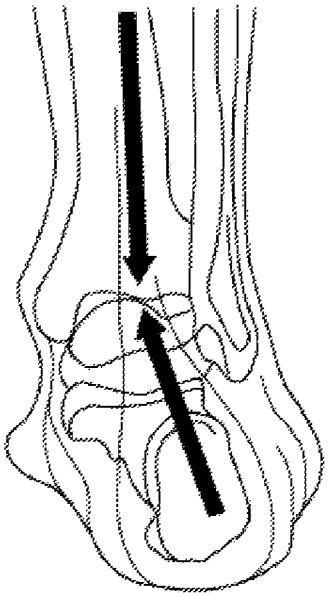

Overpronation occurs when the foot rolls too far inward during the second stage of the stance phase. As a result, overpronators push off almost completely from the big toe and second toe. FIG. 1 illustrates the relative alignment of the bones of the leg, ankle, and foot in an overpronator (1*a*), a normal subject (1*b*), and a supinator (1*c*). In overpronators, the shock of the foot's impact is not distributed evenly across the foot through heelstrike, pronation, and toe off, thus forcing the ankle to overcompensate to stabilize the body and increasing the risk of injury.

A variety of medical conditions are associated with overpronation. These include inflammatory conditions of the connective tissues supporting the foot and ankle (e.g., plantar fasciitis), as well as Achilles tendinitis, medial tibial stress syndrome (shin splints), patellofemoral syndrome, and back pain. Ligaments and tendons in the foot and ankle are particularly sensitive to sudden stresses, as occurs when a rapid rolling or twisting of the foot applies sudden stress during running or walking.

Conventional treatment for undue stresses on the foot and ankle caused by chronic injury, including overpronation, involves the use of orthotics, supportive inserts, medial posts and other stiffeners, and other support and/or cushioning devices designed to reduce the forces on the foot or to mechanically limit the foot's ability to roll. Most motion control and stability shoes are designed to normalize the range of pronation (i.e., restore pronation to a "neutral" level). However, most of these shoes do little to reduce the rate of pronation. In addition, the most stable shoes use large, dense medial posts and straight lasts to control pronation. These adaptations make most stability shoes heavy and stiff, which may not be desirable to some people.

The applicants have found that the rate of pronation may be more important for injury prevention than the range of pronation. Pronation rate is affected by the use of shoes. Shoes raise the foot and ankle above the ground and may increase heel strike, increasing both the range and rate of pronation. Studies have shown that barefoot runners have a lower rate of pronation than runners with shoes. Thus, in one embodiment of the invention, an article of footwear is disclosed that returns the pronation rate to about the same level as a barefoot subject.

Methods designed to normalize the range of pronation across all users also fail to account for the natural motion (rolling and rotation) of individual subjects that is most evident when barefoot. However, a growing body of evidence suggests that barefoot walking and running promotes the natural mechanics of the gait cycle and is associated with a reduced risk of injury. Traditional devices designed to normalize pronation by interrupting the natural roll may thus defeat the advantages of barefoot running.

Therefore, it is one object of the disclosure to provide articles of footwear, components thereof, and methods that: a) reduce the rate of pronation of the foot during physical activity, and/or b) allow, or restore, a rate and range of pronation most similar to a subject's barefoot motion.

Figure 2:
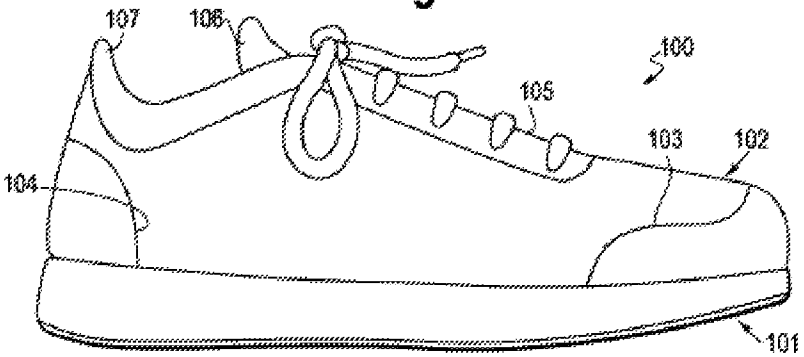
FIG. 2 is a lateral perspective of an article of footwear.
Figure 3:
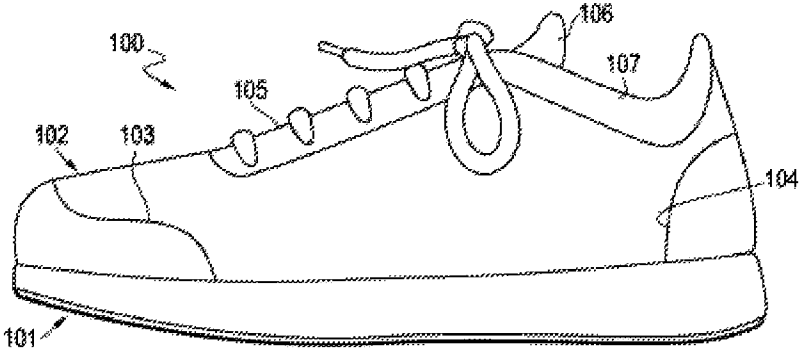
FIG. 3 is a medial perspective of an article of footwear.
Figure 4:
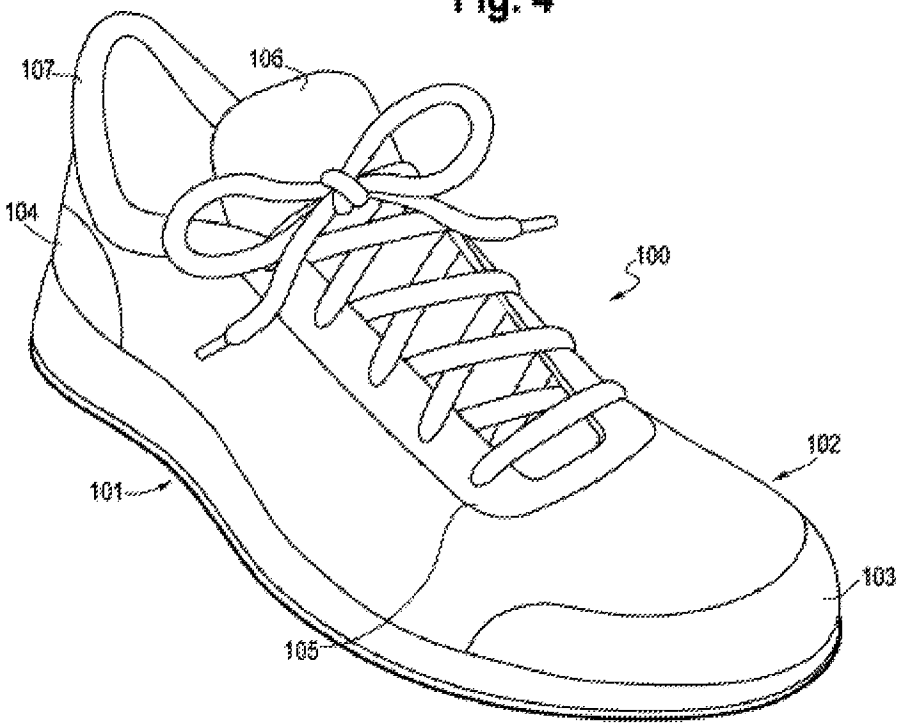
FIG. 4 is a frontal oblique perspective of an article of footwear.

An article of footwear 100 is disclosed. In the configuration of FIGS. 2-4, the article of footwear 100 includes sole structure 101 and upper 102. Although article of footwear 100 is depicted as having a configuration suitable for running, the concepts disclosed herein may be applied to a wide range of athletic footwear styles, including but not limited to basketball shoes, biking shoes, cross-training shoes, football shoes, golf shoes, hiking shoes and boots, ski and snowboarding boots, soccer shoes, tennis shoes, and walking shoes, as well as footwear styles generally considered non-athletic, including but not limited to dress shoes, loafers, and sandals. Any references herein to a "runner" or "running" are understood therefore to include any other activity that involves similar movements of the foot.

Referring to FIGS. 2-4, sole structure 101 is secured to upper 102 and extends between the foot and the ground when footwear 100 is worn. Upper 102 provides a structure for securely and comfortably receiving a foot of a wearer. More particularly, the various elements of upper 102 generally define a void within footwear 100 for receiving and securing the foot relative to sole structure 101. Surfaces of the void within upper 102 are shaped to accommodate the foot and may extend over the instep and toe areas of the foot, along the medial and lateral sides of the foot, under the foot, and around the heel area of the foot.

Given the configuration of footwear 100 discussed above, various regions of upper 102 may be generally described. In some embodiments, these regions of article of footwear 100 are structures attached to upper 102. In preferred embodiments, upper 102 is formed in a single knitting process, with various functionally and/or structurally distinct regions formed as integral parts of upper 102 during that process. As an example, toe region 103 forms a portion of the forefoot area of upper 102 and may include a wear-resistant and/or stabilizing material extending from a lateral side to a medial side of article of footwear 100. Toe region 103 is configured to provide mechanical protection to the toes (as when kicking a ball), as well as provide stabilization for the forefoot during "toe off." Heel region 104 is located around the heel of the user when article of footwear 100 is worn, and generally extends from the lateral side to the medial side of footwear 100 to form or to include a heel counter to resist lateral movements and provide support to the foot during walking, running, and other ambulatory activities. Eyestay 105 contains the eyelets for the laces, although other attachment mechanisms and methods may be used to secure the footwear to the foot of a wearer including straps, buckles, hook and loop closures. Alternatively, such closure mechanisms may be absent and the upper may have zonal stretch properties that allow the wearer to pull on the article of footwear in the same manner as a sock or bootie. Tongue 106 may be located under the laces of article of footwear 100 and serves a number of functions, for example, protecting the dorsal surface of the foot from lace pressure, securing the foot within article of footwear 100 (e.g., reducing sliding of the foot), and promoting a more comfortable fit. Collar 107 forms a rim of upper 102 for receiving the foot, and is frequently cushioned for comfort.

It is to be understood that the regions of article of footwear 100 described herein, and reflected in the figures provided, are only intended to generally illustrate the locations of commonly-referenced areas of article of footwear 100, and not to demarcate specific boundaries for such structures. For example, toe region 103 may extend substantially from a lateral side to a medial side at the forefoot area of article of footwear 100, as shown in FIGS. 2-4, but in other embodiments toe region 103 may extend only along a medial side of article of footwear, without a substantial aspect along a lateral side thereof. The person of skill in the art will understand that many other embodiments exist within the scope of the present invention.

In one aspect, article of footwear 100 includes a knitted component. In some embodiments, upper 102 is formed from a knitted component and may further include one or more non-knitted components. In some embodiments, a knitted component forms all or substantially all of upper 102.

Using a knitted component to form upper 102 may provide upper 102 with advantageous characteristics including, but not limited to, a particular degree of elasticity (for example, as expressed in terms of Young's modulus), breathability, bendability, strength, moisture absorption, weight, and abrasion resistance. These characteristics may be accomplished by selecting a particular structure including but not limited to a single layer or multi-layer knit or combination thereof (e.g., a ribbed knit structure, a single jersey knit structure, or a double jersey knit structure). These characteristics may also be accomplished by varying the size and tension of the knit structure, by using one or more yarns or strands formed of a particular multifilament yarn or monofilament strand or combinations thereof (e.g., a polyester material, thermoplastic material, a monofilament material, bulking material, or an elastic material such as spandex), by selecting yarns of a particular size (e.g., denier), or a combination thereof. In other words, through the knitting process, a selection of a particular type of knitting technique (including stitch type, stitch pattern), choice of material, and number of layers, a knitted textile having one or more different desirable properties can be created.

The knitted component may also provide desirable aesthetic characteristics by incorporating yarns having different colors or other visual properties arranged in a particular pattern. The yarns and/or the knit structure of the knitted component may be varied at different locations such that the knitted component has two or more portions with different properties (e.g., a portion forming the throat area of the upper may be relatively elastic while another portion may be relatively inelastic). In some embodiments, the knitted component may incorporate one or more materials with properties that change in response to a stimulus (e.g., temperature, moisture, electrical current, magnetic field, or light).

In some embodiments, the knitted component may be shaped after the knitting process to form and retain the desired shape of upper 102 (for example, by using a foot-shaped last). The shaping process may include attaching the knitted component to another object (e.g., a strobel) and/or attaching one portion of the knitted component to another portion of the knitted component at a seam by sewing, by using an adhesive, or by another suitable attachment process.

A knitted component may be formed as an integral one-piece element during a knitting process, such as a weft knitting process (e.g., with a flat knitting machine or circular knitting machine), a warp knitting process, or any other suitable knitting process. That is, the knitting process may substantially form the entire knit structure of the knitted component without the need for significant post-knitting processes or steps. Thus, in particular embodiments, toe region 103, heel region 104, eyestay 105, tongue 106, and/or collar 107, or any combination thereof, may be formed from a knitted component as a single material element. A knitted component may additionally or alternatively form other elements of article of footwear 100, including a midsole, strobel 108, liner, or even outsole 101, thus eliminating the need for separate construction of each element.

Thus, in some embodiments, a knitted component forms all of upper 102—including toe region 103, heel region 104, eyestay 105, tongue 106, and collar 107. In some embodiments, a knitted component forms some or all of sole structure 101, upper 102—including toe region 103, heel region 104, eyestay 105, tongue 106, and collar 107—and strobel 108 (see FIG. 7). Where a knitted component forms upper 102, as well as additional structures of article of footwear 100, each of sole structure 101, upper 102, toe region 103, heel region 104, eyestay 105, tongue 106, collar 107, and strobel 108 may be derived from regions of article of footwear 100 that would traditionally be considered an upper, a midsole, an outsole, and/or a strobel, and each of these structures may be formed as parts of a single knitted component material element.

In embodiments, a knitted component has a first side forming an internal surface of upper 102 (e.g., facing the void of article of footwear 100) and a second side forming an external surface of upper 102. Alternatively, a first side of a knitted component may be located adjacent to an internal surface of upper 102, but not necessarily forming the internal surface, with an additional layer or layers of materials between the first side and the internal surface. Similarly, a second side of a knitted component may be located adjacent to an external surface of upper 102 but not necessarily forming the external surface, with an additional layer or layers of materials between the second side and the external surface.

Upper 102 including a knitted component may substantially surround the void of article of footwear 100 so as to substantially encompass the foot of a person during use. The first side and the second side of the knitted component may exhibit different characteristics (e.g., the first side may provide abrasion resistance and comfort while the second side may be relatively rigid and provide water resistance).

Accordingly, utilization of different configurations of a knitted component in different regions of article of footwear 100, particularly in different regions of upper 102, imparts needed properties of flexibility, stability, pronation/motion control, cushioning, friction resistance, and comfort.

In some embodiments, upper 102 includes a knitted component that includes one or more support structures. Support structures may be associated with particular regions of article of footwear 100, such as toe region 103, heel region 104, eyestay 105, tongue 106, collar 107, and/or strobel 108, or they may overlap two or more regions.

In one aspect of the invention, an article comprising a textile component is thus disclosed. In some embodiments, the textile component comprises:

a) a first section comprising a first material;

b) a second section comprising a bulking yarn and disposed adjacent to the first section; and c) a third section comprising a second material, wherein the first material is relatively rigid, as compared to the second material, and wherein the second section is disposed between the first section and the third section.

In specific embodiments, the textile component is a knitted component.

In some embodiments, the first section is disposed adjacent to the external surface of the article and the third section is disposed adjacent to the internal surface of the article.

Figure 5B:
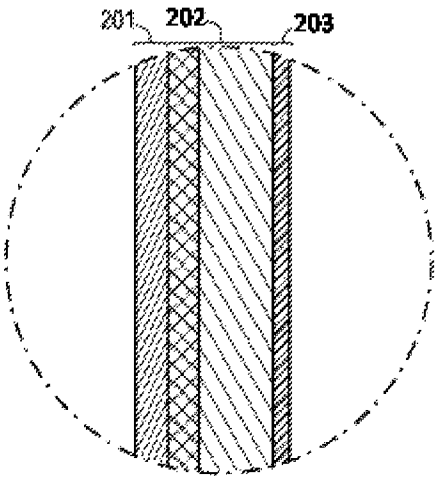
FIG. 5*b* is a diagram illustrating sections of a knitted component support structure, according to one embodiment disclosed herein.
Figure 5A:
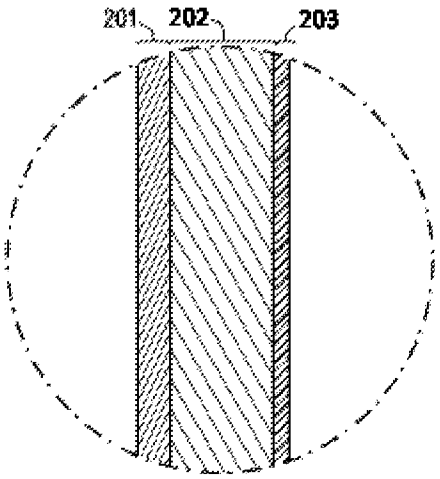
FIG. 5*a* is a diagram illustrating sections of a knitted component support structure, according to one embodiment disclosed herein.

FIGS. 5*a* and 5*b* illustrate certain embodiments of the article. Referring to FIG. 5*a*, a first section 201 comprises a rigid material. In some embodiments, the rigid material is formed from a fusible yarn. The fusible yarn may be partially or entirely fused to form a rigid structure. In some embodiments, the rigid material comprises a stiffened plate or other hardened material.

In some embodiments, the first section 201 is disposed adjacent to the external surface of the article, such as an article of footwear Referring again to FIG. 5*a*, second section 202 comprising a bulking yarn is illustrated between first section 201 and third section 203. A bulking yarn may impart loft or volume to a knitted component, as described further herein.

A third section 203 comprising a flexible material is illustrated on the right side of FIG. 5*a*. In particular embodiments, the flexible material comprises a textile. The textile may comprise a knitted component. The textile may include a nonfusible yarn, such as a polyester yarn, as further discussed herein.

In some embodiments, the first section 203 is disposed adjacent to the internal surface of the article, such as an article of footwear.

In some embodiments, a monofilament yarn is disposed between first section 201 and a bulking yarn in second section 202. Referring to FIG. 5*b*, a monofilament yarn may act as a spacer that facilitates expansion of a bulking yarn in section 202 (line of "x" within second section 202). The article may, for example, be an article of footwear, article of apparel, other clothing accessory, a household article, or a related article. For example, protective gear used in contact sports may comprise the features disclosed herein, including a first section comprising a rigid material, a second section comprising a bulking yarn, and a third section comprising a flexible material, with a first section disposed adjacent to an external surface of the protective gear, and a third section disposed adjacent to the body. In some embodiments, an article of footwear 100 is disclosed including a knitted component.

In certain embodiments, the knitted component is configured to form a support structure. The support structure may form all or part of an upper 102, toe region 103, heel region 104, eyestay 105, tongue 106, collar 107, strobel 108, arch support 109, or any combination of these, and may be configured to reduce the rate of pronation of the foot. See FIGS. 2-4.

Traditional support structures, such as arch supports and medial posts, are formed as separate structures and subsequently fitted to articles of footwear. The support structures disclosed herein can also be formed as integral portions of a knitted component, reducing labor and manufacturing costs, while reducing the amount of wasted materials that would normally be associated with separate manufacturing and assembly.

Thus, in particular embodiments, an article of footwear is disclosed, including an arch support for reducing the rate of pronation of the foot, the arch support formed from a knitted component and having:

a) a first section formed from a fusible yarn and disposed adjacent to an external surface of the article of footwear, b) a second section formed from a bulking yarn, and adjacent to the first section, and c) a third section formed from a nonfusible yarn and disposed adjacent to the internal surface of the article of footwear and opposite to the first section.

In some embodiments, a support structure includes or is divided into compartments (pods). As used herein, a compartment refers to a discrete region of a support structure with a seam or septum passing partially or entirely from the external side of the support structure to the internal side of the support structure. Compartment borders may be formed by low melt fusible yarn that melts to form rigid edges when heated. Alternatively, compartment borders may be bounded or delineated using monofilament yarn or elastic yarn. Because of the bulking yarn, compartments create "pods" or "pillows" within the support structure, particularly after heating of the bulking yarn. Compartmentation generally increases the loft, cushioning effect, and flexion of the support structure. Compartments may be configured generally concentrically within a support structure, configured in a generally parallel configuration, or in any manner that facilitates flexion of adjacent compartments responsive to applied stress during movement.

In some embodiments, the support structure is configured to provide flex lines. Flex lines refer to indentations or creases starting from the external surface of the support structure that generally do not pass entirely to the internal surface of the support structure. In some embodiments, flex lines may be oriented substantially perpendicular to the longitudinal axis of an article of footwear 100.

Compartments and flex lines permit flexion of upper 102 and create crush zones within a support structure that allow the support structure and upper 102 to at least partially collapse and absorb the impact of the gait cycle, while reducing the rate of pronation.

Referring again to FIGS. 2-4, the upper 102 for an article of footwear 100 may optionally be secured to a midsole and/or outsole 101. In some embodiments, upper 102 is configured to serve as a midsole and/or outsole 101. In particular embodiments, a ventral surface of upper 102 comprises a rigid material. A rigid material can be a fusible yarn or combination of fusible yarns with other yarns that impart rigidity to this surface, allowing it to contact the ground during physical activities.

It is understood that various knitted components and support structures for an article of footwear 100, as disclosed herein, may influence both the rate and the range of pronation, or they may be configured primarily to reduce the rate of pronation without significantly reducing the range of pronation, or to primarily reduce the range of pronation but have less influence on the rate of pronation. For example, a more rigid support structure, such as a rigid medial post or rigid arch support with a high medial elevation, may mechanically limit the range of pronation, but may actually promote a higher rate of pronation over this shorter displacement. The position, composition, and design of the disclosed support structures thus can be modified or configured to achieve various objectives to influence the rate of pronation, range of pronation, and balance the objectives of providing cushioning, support, stability, and/or rigidity to different regions of the article of footwear 100.

Figure 6:
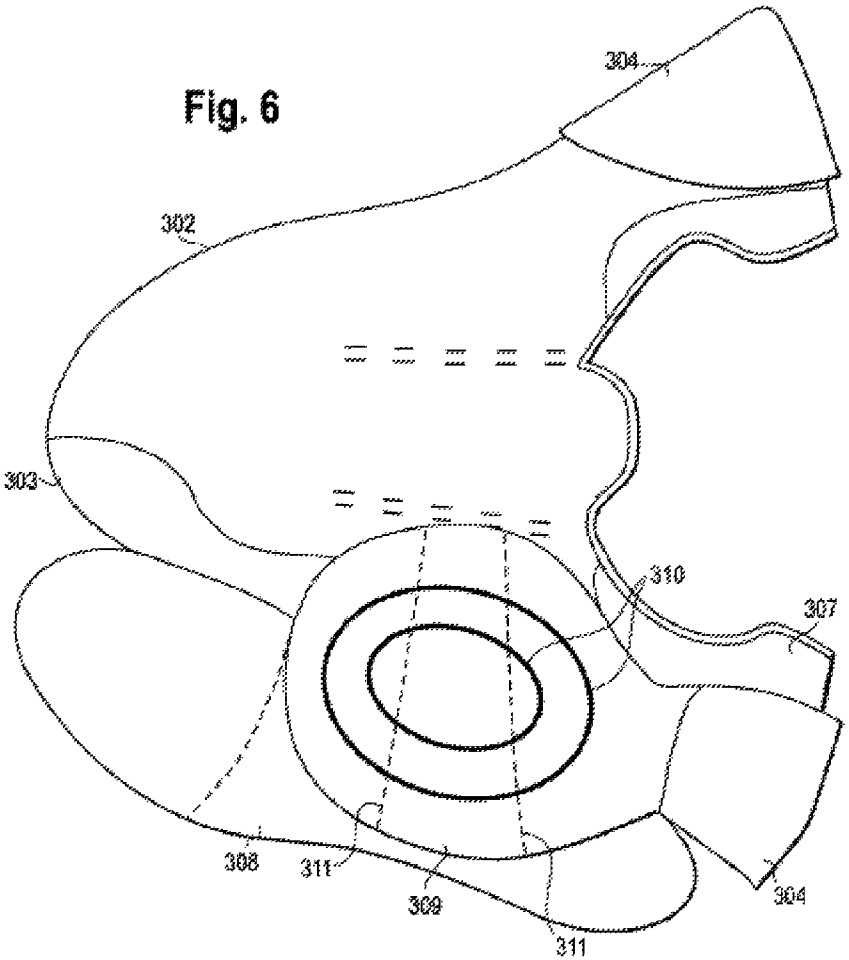
FIG. 6 illustrates a knitted component upper.

FIG. 6 illustrates an embodiment of a knitted component upper 302 incorporating features of the disclosed invention. Referring to FIG. 6, upper 302 includes an integrated toe region 303, heel region 304, collar 307, strobel 308, and arch support 309. Arch support 309 includes compartments defined by compartment borders 310, as well as a pair of flex lines 311 directed approximately perpendicular to the longitudinal axis of upper 302. Compartment borders 310 and flex lines 311 are configured to facilitate flexion and create crush zones in upper 302 during movement.

Referring again to FIG. 6, in certain embodiments, a knitted component support structure is configured to form a heel counter. A heel counter may be configured to provide rigidity and/or stability for heel region 304 of upper 302. In some embodiments, a heel counter may be relatively decoupled from the remainder of upper 302 by, for example, flex lines that allow the heel counter a great degree of flexion and motion, independent of other regions of upper 302. Similarly, and as noted herein, introduction of compartments and/or flex lines into a heel counter may create crush zones that allow the heel counter to partially collapse and flex in response to the natural bending and flexion of an article of footwear during ground contact (i.e., stance phase). Where a traditional heel counter may be formed using a relatively uniformly rigid construction, a heel counter incorporating the disclosed knitted component including, for example, the disclosed flex lines and/or compartments, may help to absorb the forces of impact and slow the rate of pronation of the foot more effectively than a more rigid, traditional heel counter. Alternatively, incorporation of the knitted component support structure into a heel counter may provide an improvement to the comfort, fit, and proprioceptive contact of the heel counter, without necessarily influencing pronation range or rate.

Physical activities such as walking and running involve a complex motor-sensory interplay that facilitates coordinated, smooth movement. Upon motor stimulation, the muscles in the leg and foot engage, activating numerous proprioceptive receptors in, for example, muscle spindles, joints, and tendons, which in turn relay detailed, real-time data about position, tension, and movement to cerebellar centers in the brain that further "fine-tune" motor circuits to complete these complex motions. Without wishing to be bound to any particular theory, it is believed that the natural movement of the foot, most characterized in a barefoot subject, allows more effective recruitment and utilization of this proprioceptive feedback circuit, facilitating more efficient and injury-free running. Thus, it is another object of the disclosure that the articles of footwear, uppers, knitted components, support structures, and methods disclosed herein further provides a proprioceptive benefit that allows the individual to more naturally control their movements.

Without wishing to be bound to any particular theory, it is believed that the support structures disclosed herein, and most particularly the disclosed arch support and heel counter provides greater early contact, and maintains more continuous contact between the foot and the shoe prior to and during the stance phase of the gait cycle. This contact improves proprioceptive responsiveness, as compared to a shoe lacking the disclosed support structures. This contact benefit may be most pronounced in the disclosed arch support.

The following definitions are provided to assist an understanding of terms used herein.

The terms "article of footwear" and "footwear" are intended to be used interchangeably to refer to the same article. Typically, the term "article of footwear" will be used in a first instance, and the term "footwear" may be subsequently used to refer to the same article for ease of readability. The term "shoe" may also be used for convenience to refer to an "article of footwear" or "footwear."

The term "textile" or "textile component," as used herein, includes woven, nonwoven, and knitted fabrics or cloth. While frequent reference is made herein to "knitted component", "knitted upper," and the like, it is understood that other textiles may also be employed in these and other embodiments, without departing from the scope and spirit of the invention.

As used herein, the terms "range," "amount," "degree," "extent," or the like, when referring to movement of the foot, refer to a parameter that is measured in terms of physical distance or displacement. For example, the range of pronation of the foot is a measure of how far the foot pronates from a neutral position, as further defined below, rather than a measure of the forces, rate, or acceleration associated with pronation.

As used herein, the term "rate of pronation" refers to the speed at which the foot rolls in (sometimes also referred to as everts) during pronation. Various methods exist for measuring the rate of pronation, as outlined further herein. A corresponding "rate of supination" may also be defined in terms of the speed by which the foot rolls out during supination (either naturally as during the "swing phase" of the gait cycle, or abnormally as with an individual who underpronates or supinates during activity).

The terms "about", "approximately", and "substantially", when used herein with respect to measurable values, include a range of values around the recited value, due to expected variations known to those skilled in the art (e.g., limitations and variability in measurements). For example, "about" and "substantially" may refer to a range that is within 10%, 9%, 8%, 7%, 6%, 5%, 4%, 3%, 2%, or 1% (either greater than or less than) of a specified value, as recited in the claims hereto.

Underpronation, as used herein, refers to the condition where the foot does not roll inward adequately during the second stage of the stance phase or, alternatively, when the foot rolls outward (supinates or inverts) during the second stage. In underpronators/supinators, the forces of impact are not transferred effectively to the big toe, creating greater stress on the lateral base of the forefoot and smaller toes.

Though less common than overpronation, underpronation is also associated with increased risk of injury. While the disclosure provides articles and methods that are suitable for reducing the rate of pronation (such as an arch support formed from a knitted component of an upper), the person of skill in the art will understand that the structures and methods disclosed can be modified and/or repositioned to similarly reduce the rate and/or range of underpronation/supination.

As used herein, the terms "adjacent" or "adjacent to" means that a first item is disposed near or close to a second item; however, the first item and the second item may or may not share a common border or be abutting. For example, the phrase "A is disposed adjacent to B" means that A is near B, particularly when compared to other items also being described, but other items not specifically referenced may also be disposed between A and B.

Similarly, as used herein, the term "between" means that a first item is disposed in a space that separates two other items; however, the first item may or may not share a common border or be physically abutting with either or both of the two other items. For example, "A is between B and C" means that A is disposed in the space separating B and C, but other items may also be disposed between B and C.

As used herein, the terms "rigid" or "relatively rigid" (hereinafter collectively referred to as "rigid") refers to a material that does not readily bend or deform under the forces associated with movement of an article during normal activities, such as walking and running, but does not require absolute rigidity. Some examples of rigid materials that may be suitable for certain embodiments disclosed herein include hard plastic, steel, or fusible yarn that has been either partially or completely fused.

As used herein, the term "flexible" or "relatively flexible" refers to a material that readily bends or deforms under the forces associated with movement of an article during normal physical activities, such as normal walking and running. A flexible material includes, for example, various soft plastics, nonfusible yarns, textiles, or fabric that is capable of flexing and/or being displaced with relatively little force. Suitable flexible materials allow expansion of underlying sections of a knitted component, such as expansion of the second section as a bulking yarn is heated. A "flexible" material will thus bend or deform more readily under such forces than a "rigid" material will bend or deform under comparable forces, as disclosed herein. Thus, the terms "rigid" and "flexible" may also be used relative to each other, particularly as when two materials are described in comparison herein or in the appended claims.

As used herein, the term "arch support" refers to a component located at least partially under the arch of the foot to provide support and relieve strain on the foot during walking, standing, running, etc. An arch support may also extend beyond the "arch" region under the foot to provide support and stability to the medial surface of the foot. In certain embodiments, a knitted component forms an arch support, wherein the arch support is configured to reduce the rate of pronation of the foot.

As disclosed herein, a knitted component, including a support structure, may be formed using a combination of different yarns, each with distinct properties.

A "bulking yarn," as used herein, generally refers to a yarn that provides bulk, loft and/or increased volume to a particular region, as for example between or adjacent to two other components or yarn types. In some embodiments, the individual fibers of a bulking yarn are treated so that they do not follow a linear path; air spaces are developed within the yarn, leading to increased loft. Increase in loft provided by a bulking yarn may be due to a variety of factors including, but not limited to, how much of the yarn is packed into a particular region or area, the number of ends, the denier, etc. or a combination thereof.

Bulking yarns may or may not be responsive to heat. For example, some bulking yarns may be treated with heat to increase loft still further. Thus, a bulking yarn may have two or more states, with one state having an increased loft upon heating, as compared to the non-heated state. This heat setting process can be achieved using dry heating or steam heating (with or without pressing the yarn or the textile comprising the yarn). Alternatively, a bulking yarn may have no change in bulk/loft/volume upon being subjected to heat. Thus, in some embodiments, a bulking yarn provides bulk and/or loft in a region, but its loft does not increase in response to treatment, such as heat treatment. A bulking yarn may be used in areas of an article, such as article of footwear 100, where cushioning or softness are desired. In certain embodiments, a bulking yarn is introduced into a knitted component using inlaid stitching between a fusible yarn and a nonfusible yarn. A "fusible yarn," as used herein, refers to a thermoplastic or thermoformable yarn that transitions from a solid state to a softened or liquid state when subjected to temperatures at or above its melting point and transitions back to the solid state when cooled. For example, a knitted component may include yarns formed of a thermoplastic polymer material. Fusible yarns may be formed using various thermoplastic materials, including polyethylene, polyamide, polyester, polyolefin, polyurethane, or a copolymer of one or more of these to impart a range of properties to the yarn. The thermoplastic polymer material may provide the ability to heat and then cool a portion of the knitted component to thereby form an area of bonded or continuous material that exhibits certain advantageous properties, including a relatively high degree of rigidity, strength, and water resistance, for example.

The melting point of fusible yarns may be determined by the specific composition and arrangement of filaments in the yarn. For example, a fusible yarn may have a melting point between 60 C and 160 C, inclusive of and including each temperature between. Fusible yarns have a range of thread counts, such as between 23 dtex and 1100 dtex. Fusible yarns can also be stitched, knitted or woven.

Heating of fusible yarn may be achieved, for example, by free steaming, press steaming, or dry heating—with or without pressing. In a preferred embodiment, a fusible yarn is free steamed. When treated this way, a fusible yarn component or section of upper 102 forms a stiff structure that may resemble the stiffness of a heel counter, imparting stability to upper 102 in that area. Applying pressure and heat simultaneously to the fusible yarn in the support structures disclosed herein as (for example, by free steaming and pressing) unexpectedly created a less stiffened structure than free steaming alone. Thus, it is preferred to use free steaming alone when heating the disclosed knitted components.

A nonfusible yarn, as used herein, refers to any of a variety of yarns that may have a distinct yarn structure from a bulking or fusible yarn, as disclosed herein. Various nonfusible yarns may be used to provide boundary layers, as for example between two regions of upper 102 or between different sections of a support structure. In one example, a nonfusible yarn, as disclosed herein, may have a melting temperature greater than a corresponding fusible yarn, such that it does not melt at temperatures that would otherwise cause melting (fusion) of an adjacent or associated fusible yarn. Nonfusible yarns suitable for this purpose may include various polyester yarns. In some embodiments disclosed herein, a nonfusible yarn allows an adjacent bulking yarn to expand on heating and forms a relatively flexible boundary for the disclosed support structure.

A monofilament yarn, as used herein, refers to single filaments of synthetic fibers that are strong enough to be useful in, for example, a knitted component, without being twisted with other filaments. Monofilament yarns may be derived from, for example, polyethylene or polypropylene. In certain embodiments, a monofilament yarn is disposed between a fusible yarn and a bulking yarn, acting as a spacer that facilitates greater expansion of the bulking yarn, particularly on heating. Monofilament yarns may be introduced into a knitted component using cross tuck stitching.

Referring to FIGS. 5-6, embodiments of a heel region 304 and arch support 309 may thus be described in terms of the yarns and knitting patterns used therein.

In one embodiment, heel region 304 is described forming a heel counter. Referring to FIGS. 5*a* and 6, first section 201 may be disposed adjacent to an external surface of a knitted component and includes a fusible yarn and zero, one, or more than one courses of elastic yarn. First section 201 may subsequently be heated and fused to form a rigid backing to heel region 304. Second section 202 includes a bulking yarn that expands upon heating. Third section 203 is disposed adjacent to the internal surface of a knitted component and includes a flexible, nonfusible yarn that allows for the expansion of second section 202 and heel region 304 upon heating, forming a heel counter.

In one embodiment, arch support 309 is described. Referring to FIGS. 5*b* and 6, first section 201 is disposed adjacent to an external surface of the knitted component and includes a fusible yarn and zero, one, or more than one courses of elastic yarn. First section 201 may subsequently be heated and fused to form a rigid backing to arch support 309. Second section 202 may include a monofilament yarn (left side of second section 202 in FIG. 5*b*, indicated in one embodiment by a line of "x" in FIG. 5*b*) knitted using cross tuck stitching to form a spacer within second section 202. In some embodiments, a monofilament yarn may extend substantially between first section 201 and third section 203, encompassing most or all of second section 202, and may be engaged with other yarns, for example bulking yarns, in second section 202. Third section 203 includes a flexible, nonfusible yarn that allows for the expansion of second section 202 and arch support 309 upon heating.

Variations on these disclosed knitting patterns may be suitable in other regions of a knitted component in, for example, article of footwear 100. For example, collar 107 may be formed using substantially the same yarns and knitting pattern as discussed in arch support 309, except that first section 201 disposed adjacent to the external surface of the knitted component may include only elastic yarn and no fusible yarn. This configuration enhances the flexibility of collar 107, allowing a user to more easily fit their foot into article of footwear 100, while retaining the benefits of a bulking yarn and other components described herein.

Figure 7:
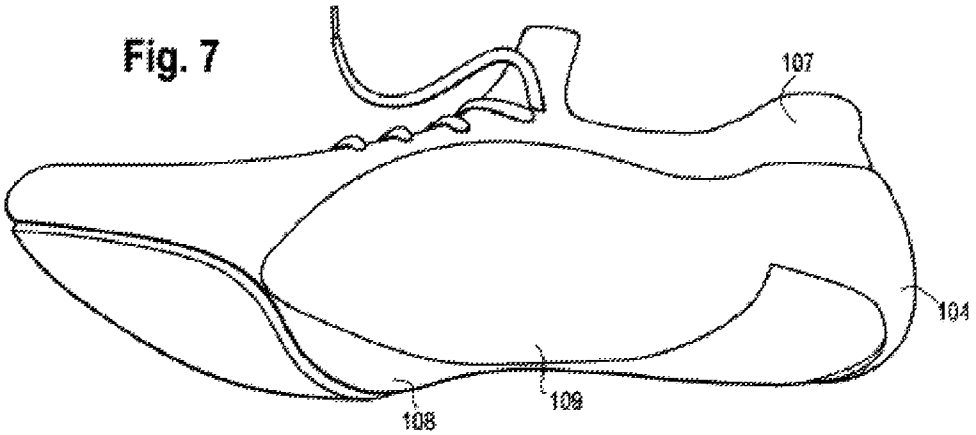
FIG. 7 is a medial perspective of an article of footwear, illustrating an arch support.
Figure 8:
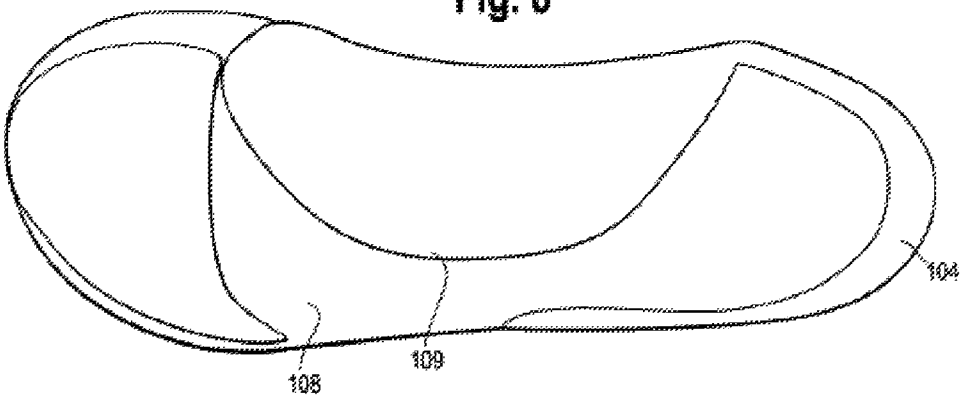
FIG. 8 is a ventral perspective of an article of footwear, illustrating an arch support.

As discussed herein, the disclosed arch support may extend beyond the traditional arch region under the foot to include a substantial medial component. FIGS. 7 and 8 illustrate an embodiment of arch support 109 according to the present invention.

Referring to FIG. 7, arch support 109 extends into an area that would normally be occupied by strobel 108 to include a substantial portion of the ventral surface of the foot (on the medial side), as well as a substantial portion of the medial surface of the foot, extending as far back as heel region 104.

FIG. 8 illustrates a ventral perspective of upper 102 formed from a knitted component, including arch support 109. Referring to FIG. 10, arch support 109 is again seen to constitute a substantial portion of the arch and ventral surface of the foot, replacing much of integrated strobel 108.

As is apparent from the embodiments of FIGS. 7 and 8, arch support 109 may constitute (or effectively replace) a substantial portion of the medial surface of the shoe, including much of the vamp and quarter, as well as much of the ventral surface, particularly in the arch. The disclosed arch support 109 is thus significantly larger and has a significantly greater medial aspect than traditional arch supports. It is believed that this extensive coverage, particularly when integrated into a knitted component, contributes to the ability of arch support 109 to reduce the rate of pronation, range of pronation, and/or to return the rate of pronation to about the rate of a barefoot subject.

In one aspect of the invention, methods are disclosed for forming an article comprising a textile component.

In some embodiments, a method for forming an article comprising a textile component comprises:

a) forming a first section comprising a first material;
b) forming a second section comprising a bulking yarn and disposed adjacent to the first section; and
c) forming a third section comprising a second material, wherein the first material is relatively rigid, as compared to the second material, and wherein the second section is disposed between the first section and the third section.

In certain embodiments, the textile component is a knitted component. In specific embodiments, forming comprises knitting a first section, second section, and third section together, as disclosed herein.

In one embodiment, a method for forming a knitted component support structure is disclosed, the method comprising:

a) forming a first section comprising a fusible yarn;
b) forming a second section comprising a bulking yarn adjacent to the first section;
c) forming a third section comprising a nonfusible yarn adjacent to the second section and opposite to the first section, and
d) heating the first section, second section, and third section of the knitted component to form a knitted component support structure.

The support structure may be for an article of footwear. In some embodiments, the support structure comprises an arch support or heel counter.

In specific embodiments, forming comprises knitting a first section, second section, and third section.

In a preferred embodiment, heating comprises free steaming.

In a preferred embodiment, the yarns of a knitted component are knitted unsteamed, then subsequently steamed to facilitate fusion of a first section and/or bulking of a second section. Heating after knitting creates a desired loft of the bulking yarn while simultaneously (at least partially) fusing the fusible yarn. In addition, heating after knitting (rather than first heating the yarns) saves labor and manufacturing costs and simplifies the overall process.

In one embodiment, a method is provided for forming an article of footwear comprising an arch support, the method comprising:

a) knitting a first section from a fusible yarn;

b) knitting a second section from a bulking yarn adjacent to the first section; and c) knitting a third section from a nonfusible yarn adjacent opposite the first section.

In a preferred embodiment, the first section is disposed adjacent to the external surface of the article of footwear, and the third section is disposed adjacent to the internal surface of the article of footwear.

In a preferred embodiment, the first section, second section, and third section are heated after knitting, to at least partially fuse the fusible yarn and form a rigid material and to expand the bulking yarn.

In some embodiments, a monofilament yarn is knitted between the first section and second section. In some embodiments, the arch support is knit including compartments and/or flex lines. In a preferred embodiment, the arch support reduces the rate of pronation of the foot.

Although the present disclosure has been described with reference to preferred embodiments, workers skilled in the art will recognize that changes may be made in form and detail without departing from the spirit and scope of the disclosure.

The invention claimed is:

1. An article of footwear comprising an arch support, the arch support comprising:

a) a knitted component having a first knit layer formed from a fusible yarn and disposed adjacent to an external surface of the article of footwear;

b) the knitted component having a second knit layer formed from a non-fusible yarn, the second knit layer being disposed adjacent to an internal surface of the article of footwear, and the second knit layer being separable from the first knit layer such that a pocket is formed between the first knit layer and the second knit layer; and c) a bulking yarn inlaid between the first knit layer and the second knit layer in the pocket such that the bulking yarn is unsecured from the first knit layer and the second knit layer inside the pocket, wherein the pocket is located in an arch area of the article of footwear, wherein the knitted component extends from the arch support to a collar of the article of footwear.

2. The article of footwear of claim 1, wherein the arch support reduces the rate of pronation of a foot.

3. The article of footwear of claim 1, wherein the arch support further comprises a monofilament yarn disposed between the first knit layer and the second knit layer.

4. The article of footwear of claim 1, wherein the bulking yarn has a first state and a second state, the second state having an increased loft relative to the first state, wherein the bulking yarn transitions from the first state to the second state on heating.

5. The article of footwear of claim 1, wherein the fusible yarn melts upon heating to form a more rigid material, as compared to the fusible yarn before heating.

6. The article of footwear of claim 1, wherein the arch support is divided into compartments.

7. The article of footwear of claim 1, wherein the arch support comprises flex lines that flex in response to motion of the article of footwear.

* * * * *